US008713779B2

(12) United States Patent
Acciari

(10) Patent No.: US 8,713,779 B2
(45) Date of Patent: May 6, 2014

(54) SYSTEM AND METHOD FOR PREPARING WINDING MANDRELS FOR FORMING REELS

(75) Inventor: Giuseppe Acciari, Porcari-Lucca (IT)

(73) Assignee: A. Celli Nonwovens S.p.A., Porcari (IT)

( * ) Notice: Subject to any disclaimer, the term of this patent is extended or adjusted under 35 U.S.C. 154(b) by 962 days.

(21) Appl. No.: 12/667,421

(22) PCT Filed: Jul. 4, 2007

(86) PCT No.: PCT/IT2007/000483

§ 371 (c)(1),
(2), (4) Date: May 20, 2010

(87) PCT Pub. No.: WO2009/004659

PCT Pub. Date: Jan. 8, 2009

(65) Prior Publication Data

US 2010/0243789 A1 Sep. 30, 2010

(51) Int. Cl.
*B23P 19/00* (2006.01)
*B65H 19/30* (2006.01)

(52) U.S. Cl.
USPC ..... 29/426.2; 242/533

(58) Field of Classification Search
USPC ..... 29/426.2, 412, 428; 242/533, 533.1, 242/533.7, 530.1, 530.3; 414/225.01; 901/27, 30
See application file for complete search history.

(56) References Cited

U.S. PATENT DOCUMENTS

| | | | |
|---|---|---|---|
| 5,076,750 | A | 12/1991 | Mandotti |
| 5,941,474 | A | 8/1999 | Cushing |
| 6,655,629 | B1 | 12/2003 | Acciari |

FOREIGN PATENT DOCUMENTS

| | | |
|---|---|---|
| EP | 0 360 948 | 4/1990 |
| EP | 0 767 123 A2 | 4/1997 |
| EP | 1 306 332 A2 | 5/2003 |
| EP | 1 344 735 Al | 9/2003 |
| IT | WO 99/02439 | 1/1999 |

*Primary Examiner* — John C Hong
(74) *Attorney, Agent, or Firm* — McGlew and Tuttle, P.C.

(57) ABSTRACT

Disclosed is a system to be combined to one or more rewinding machines (1) for forming reels or logs of web material wound around winding mandrels. The system, whose function is to prepare the winding mandrels with the related winding cores positioned thereon, comprises in combination: a robot (5) for extracting winding mandrels (A) from formed reels (BB); a cutting unit (7) for cutting tubes (T) for forming tubular winding cores (AT) of settable axial length; an insertion unit (9), for introducing the winding mandrels into a set of tubular winding cores.

26 Claims, 16 Drawing Sheets

SYSTEM AND METHOD FOR PREPARING WINDING MANDRELS FOR FORMING REELS

TECHNICAL FIELD

The present invention relates to improvements to the systems for handling winding mandrels for winding web materials in reels and the relative methods.

STATE OF THE ART

In the converting of continuous web materials, such as paper, nonwoven fabric, tissue paper and similar products, a continuous production machine is usually interfaced with a winding system, which forms parent reels of large diameter and high axial length. Subsequently, these parent reels must be unwound and rewound to form reels of smaller dimensions. In particular winding or rewinding machines are used, which receive continuous web material from a parent reel and, by cutting the web material into strips of lesser width with respect to the width of the initial material, form reels around tubular winding cores mounted and clamped on winding mandrels. The winding mandrels can be expanded by means of a mechanical or pneumatic system, in such a way as to block tubular winding cores in the desired positions to form the reels. Once these reels have been formed, the mandrel is contracted so it can be extracted from the tubular winding cores, on which the reels were formed, and reutilized in a subsequent winding cycle.

The axial dimension of the tubular winding cores varies according to the specific requirements that from time to time can emerge during the production phase. It is therefore necessary to have available systems or apparatuses that allow fast, as automated as possible and safe preparation of the tubular winding cores on the mandrels. U.S. Pat. No. 6,655,629 describes a system for extracting the tubular mandrels from the reels formed in a rewinding machine, inserting each mandrel into a tube of cardboard, plastic or other material, reciprocally clamping the mandrel and the tube, cutting the tube at the desired points for transforming it into a set of tubular cores already blocked on the mandrel, and introducing the mandrel with the tubular cores fitted on it into the rewinding machine for forming the subsequent series of reels.

This system is flanked to a single rewinding machine and allows to automate the preparation cycle of the winding cores destined to the rewinding machine itself. In this system the cutting of the tube and its division into individual tubular cores takes place by means of blades that work with the tube inserted around the respective winding mandrel and locked thereon, so that the winding mandrel constitutes a pressure surface against which the cutting blades work. This causes drawbacks due to the wear to which the mandrel is subject because of the action of the cutting blades. Furthermore, the mandrels must be particularly strong to withstand the stresses exerted by the blades.

OBJECTS AND SUMMARY OF THE INVENTION

According to an aspect, an object of the present invention is to provide a system for preparing winding mandrels with winding cores inserted thereover, which entirely or in part overcomes the drawbacks of the known systems.

The object of an embodiment of the invention is to provide a system for preparing winding mandrels, in which the problem of the wear caused to the mandrel by the cutting blades is avoided.

Essentially, according to an embodiment, the invention discloses a system for preparing winding mandrels on which to form reels of web material, comprising in combination:

- a robot for extracting winding mandrels from formed reels;
- a cutting unit for cutting a tube for forming tubular winding cores of settable axial length;
- an insertion unit for inserting the winding mandrels into a series of tubular winding cores.

In a possible embodiment, the robot presents a head provided with gripping members for gripping the winding mandrels, and with an expansion and contraction member for expanding/contracting the winding mandrels, to cause the expansion of the mandrels and the locking thereon of the tubular winding cores, or the contraction of the mandrels and the unlocking of the tubular winding cores from these mandrels. This expansion and contraction member can be a mechanical member. According to a currently preferred embodiment of the invention, this expansion member is a pneumatic member.

Preferably, the expansion and contraction member for expanding/contracting the winding mandrels is able to assume an operating position and an idle position with respect to said gripping members.

The members for gripping the winding mandrels, provided on the handling head of the robot, can comprise at least a first pair of jaws and preferably at least two pairs of jaws so aligned to engage the winding mandrels in two longitudinally distanced points. A further gripping element for gripping the shank of the winding mandrels may be provided. Preferably, this further gripping element is composed of section bars integral with one of the pairs of jaws provided for gripping the winding mandrel on its outer surface.

In an embodiment, with the insertion unit for inserting the winding mandrels into the winding cores a rest for the winding mandrels is associated, on which the robot places each individual winding mandrel before the winding mandrel is introduced into the winding cores. It would also be possible for the introduction to be carried out without the aid of said rest, but rather using the robot for holding and pushing the mandrel into the tubular cores, which for this purpose are locked in the insertion unit by means of a specific clamping member.

In a possible embodiment, the cutting unit comprises: a supporting cradle for supporting the tubes with a system of rotation of the tube to be cut; a cutting member; a feeder to feed the tube to be cut to the cutting member. Preferably, the supporting cradle comprises a pair of rollers with substantially parallel axes, at least one of which can be motorized to carry said tubes in rotation.

According to a different aspect, the present invention relates to a method for preparing winding mandrels by applying on them tubular winding cores for forming reels of web material. Substantially, according to an embodiment the method of the present invention comprises the steps of:

- extracting a winding mandrel from previously formed reels of web material;
- inserting said mandrel into a set of tubular winding cores previously cut to size and axially aligned;
- transferring the winding mandrel, with the tubular winding cores inserted thereover, towards a rewinding machine for forming reels of web material around said tubular winding cores.

In an embodiment, the method further comprises the steps of:

- axially approaching said tubular winding cores to each other;

after insertion of said winding mandrel into the tubular winding cores, distancing the winding cores from each other before inserting them into the rewinding machine.

According to a further aspect, an object of the invention is to provide a robot with a head particularly suitable for handling of expandable winding mandrels on which to lock tubular winding cores. Substantially, in an embodiment a robot is provided comprising an arm carrying a head with gripping members for gripping the mandrels and an expansion and contraction member for expanding/contracting the winding mandrels, to lock tubular winding cores on said mandrels and unlock them therefrom.

A robot with a so shaped head is particularly suitable for being used in a system of the type defined above, to implement a method as indicated above. However, it would also be possible to use the robot with said head in other kinds of systems.

Further advantageous features and possible embodiments of the system, of the method and of the robot according to the invention are indicated in the appended claims and shall be described in greater detail hereunder with reference to a non-limiting embodiment.

BRIEF DESCRIPTION OF THE DRAWINGS

The invention shall be better understood by following the description and accompanying drawing, which shows a non-limiting practical embodiment of the invention. More specifically, in the drawing:

FIGS. 7A-7D show a schematic representation in sequence of the insertion of the winding mandrel into a group of tubular winding cores, axially aligned to each other.

DETAILED DESCRIPTION OF AN EMBODIMENT OF THE INVENTION

Figure 1:
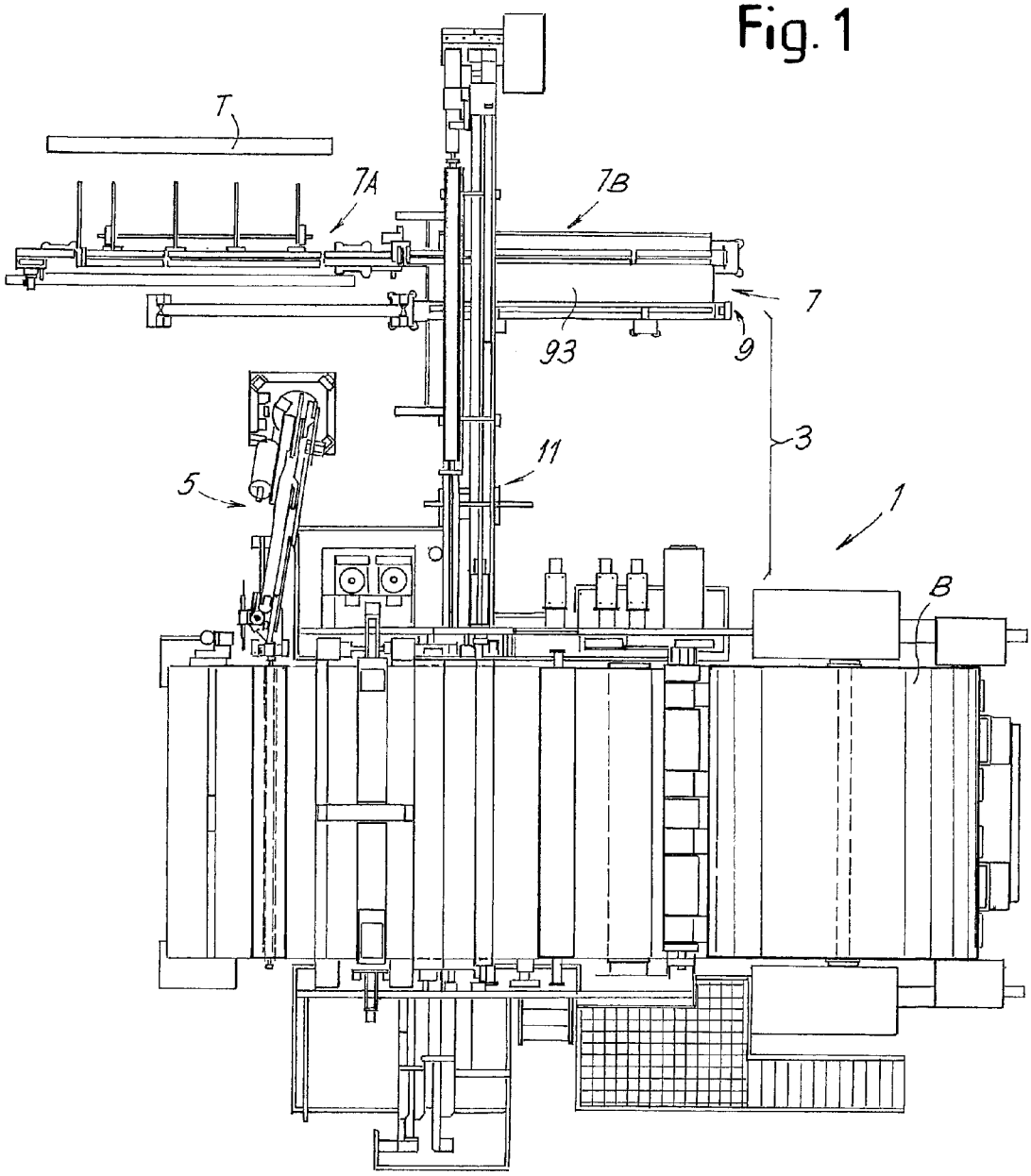
FIG. 1 shows a plan view of the system according to the invention, combined to a rewinding machine.
Figure 6:
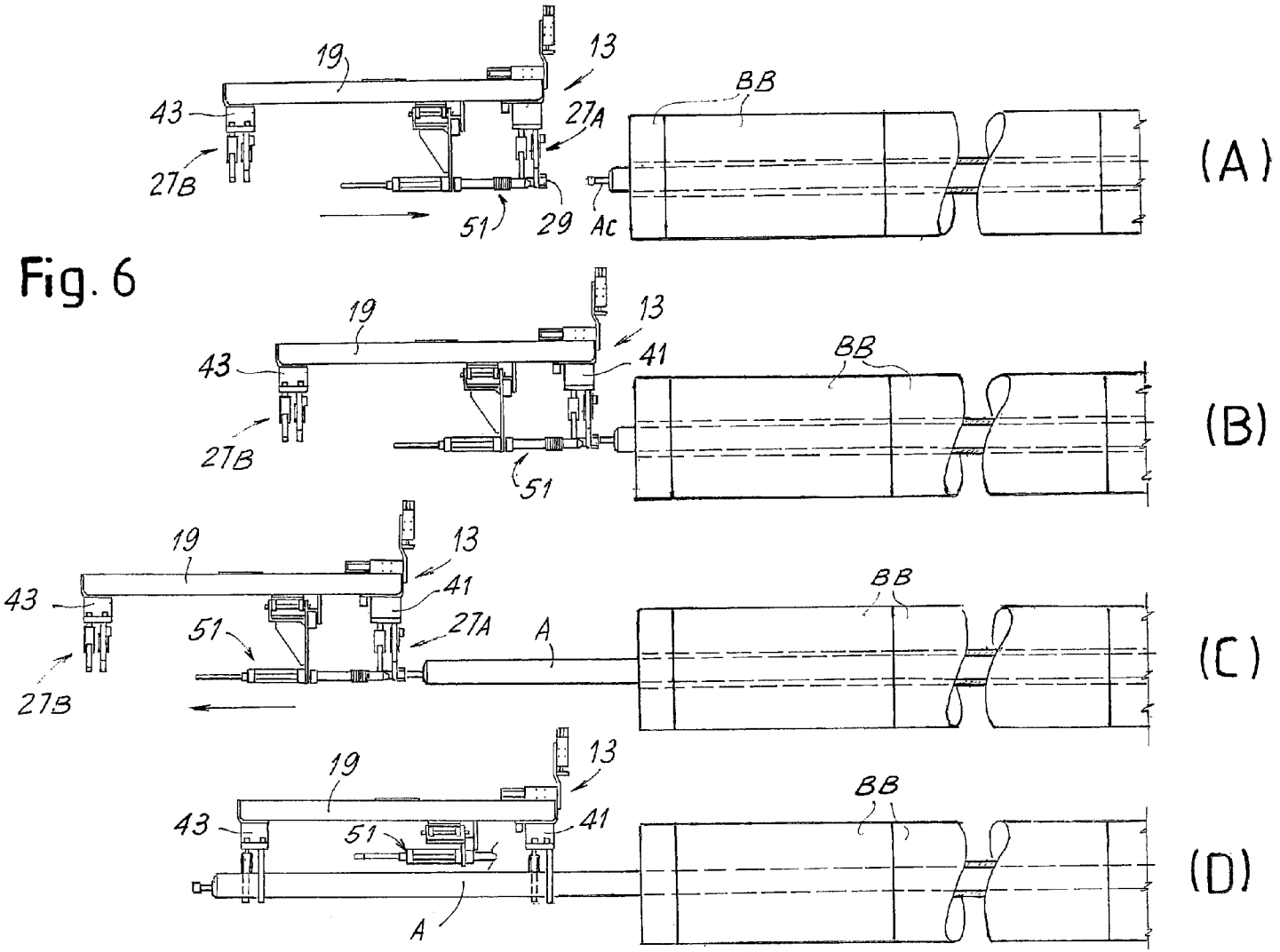
FIGS. 6A-6D show a schematic representation in sequence of the operations of extraction of the winding mandrel from a group of formed reels.

With initial reference to FIG. 1, number 1 schematically indicates a rewinding machine for forming reels BB (FIG. 6) of web material by unwinding, continuous longitudinal cutting and rewinding of the web material from a parent reel B. The reels BB are formed by simultaneously winding around tubular winding cores strips of web materials of equal or different widths, obtained by longitudinal cutting of the web material dispensed by the parent reel B.

To the side of the rewinding machine 1 is positioned a set of machines forming a system or apparatus indicated as a whole with 3, for extracting the mandrels from the reels formed in the rewinding machine 1, inserting them into tubular cores cut to size starting from tubes of standard lengths, also obtained by means of the system 3 cutting a tube into segments, and inserting the mandrels—with the tubular cores inserted thereover and clamped—into the winding area of the rewinding machine 1, possibly after mutually distancing the tubular winding cores on the individual mandrels to facilitate the regular formation of the reels around the individual winding mandrels.

In more detail, the system 3 comprises a robot 5 for handling the mandrels, a cutting unit 7 for cutting tubes of cardboard, plastic or the like into individual tubular winding cores, an insertion unit 9 for inserting individual winding mandrels into groups of axially aligned tubular winding cores, obtained by cutting the individual tubes inside the unit 7.

In the illustrated embodiment, the system 3 further comprises a unit 11 above, in which the mandrels equipped with tubular cores are introduced by the robot 5 to enable the mutual axial distancing of the tubular winding cores before introducing the mandrel and the cores into the rewinding machine 1. The unit 11 can be designed as described in greater detail in the co-pending international patent application PCT/IT2006/000109 by the same Applicant, whose content is wholly incorporated herein and is understood to be wholly transcribed in the present description. The details of the unit 11 therefore will not be described herein.

Figure 2:
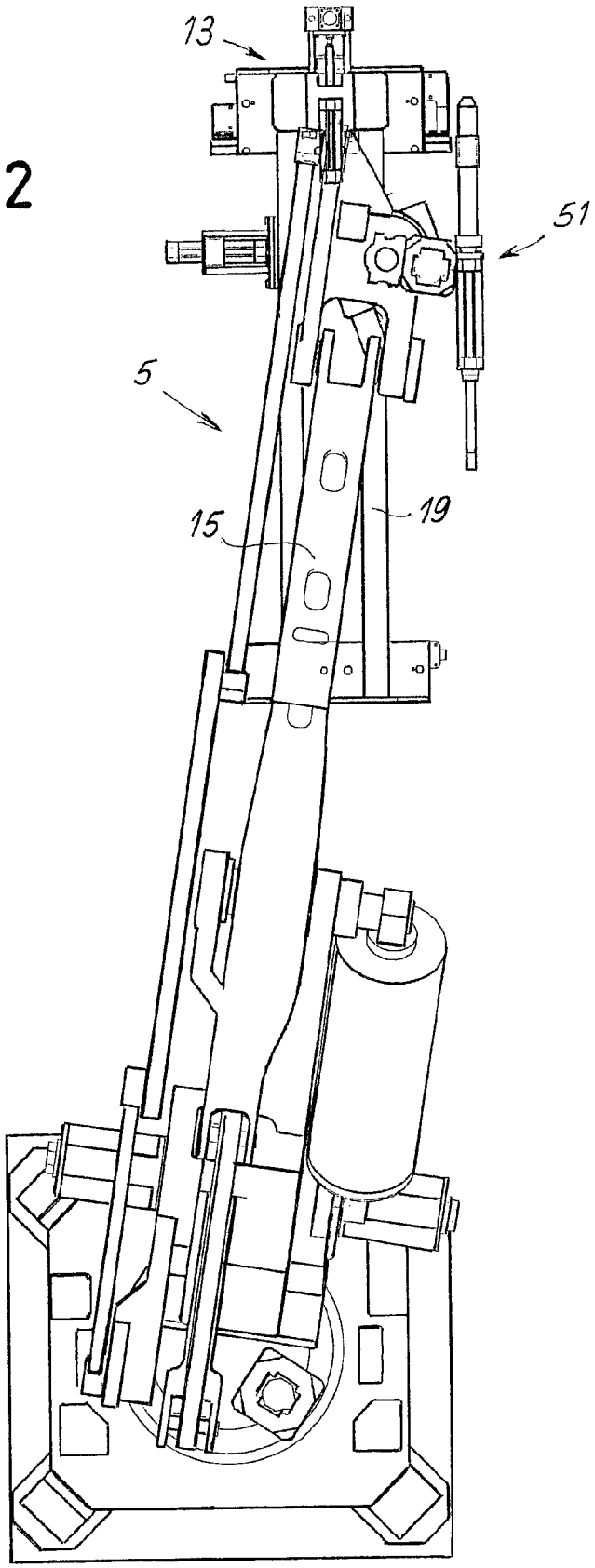
FIG. 2 shows an enlargement of the plan view of the robot for the handling of the mandrels.
Figure 3A:
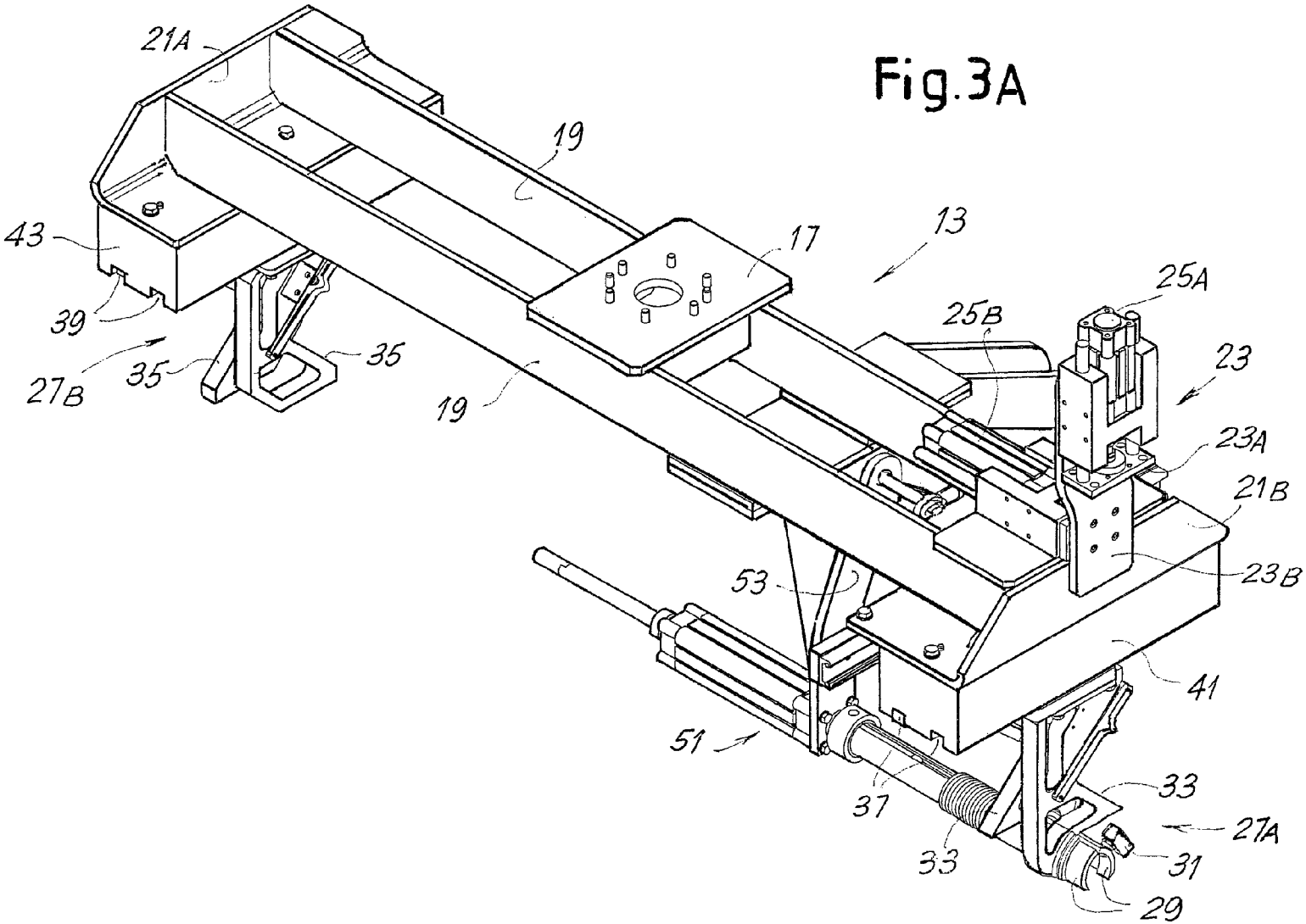
FIGS. 3A-3E show different views of the robot head.
Figure 3B:
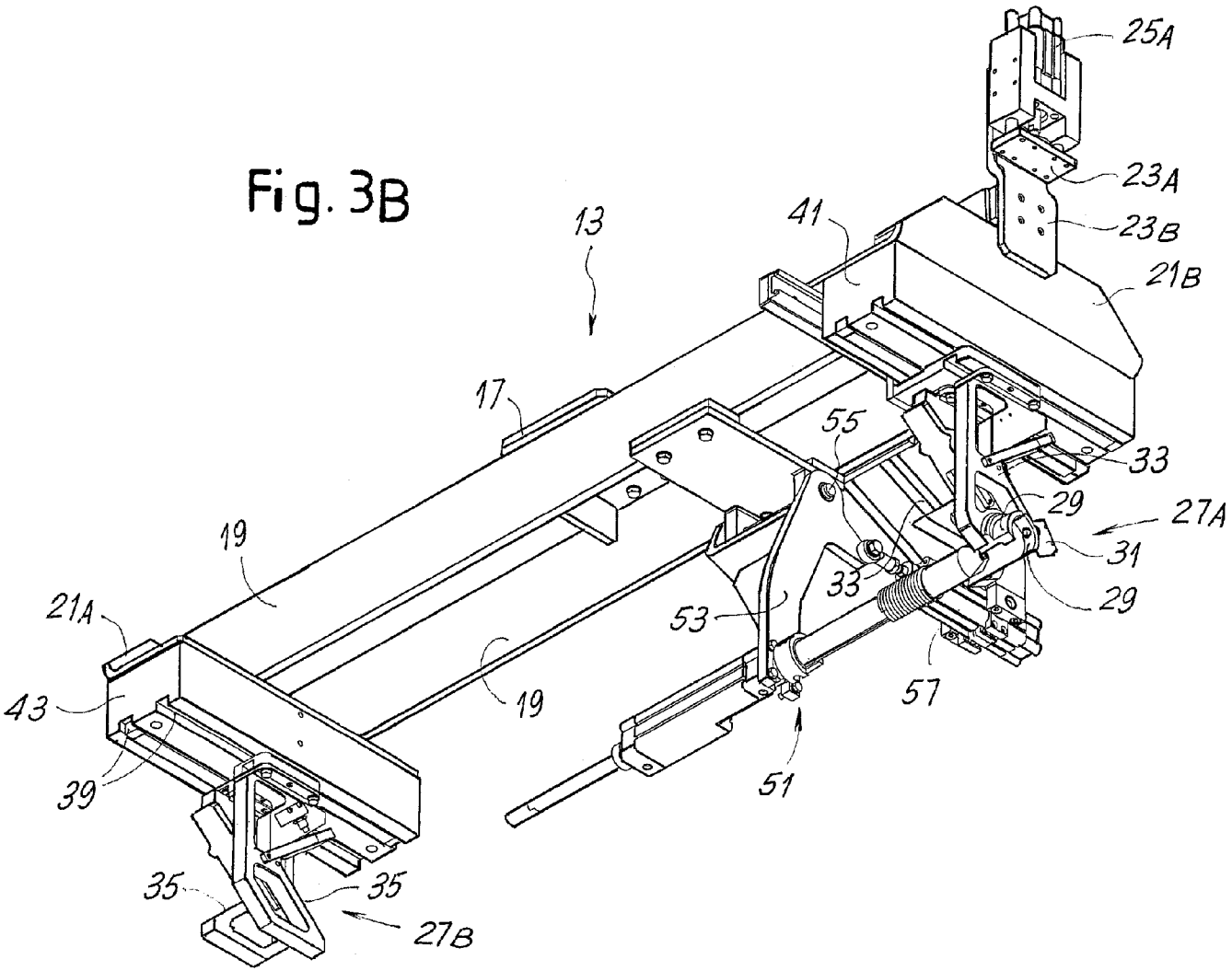
Figure 3C:
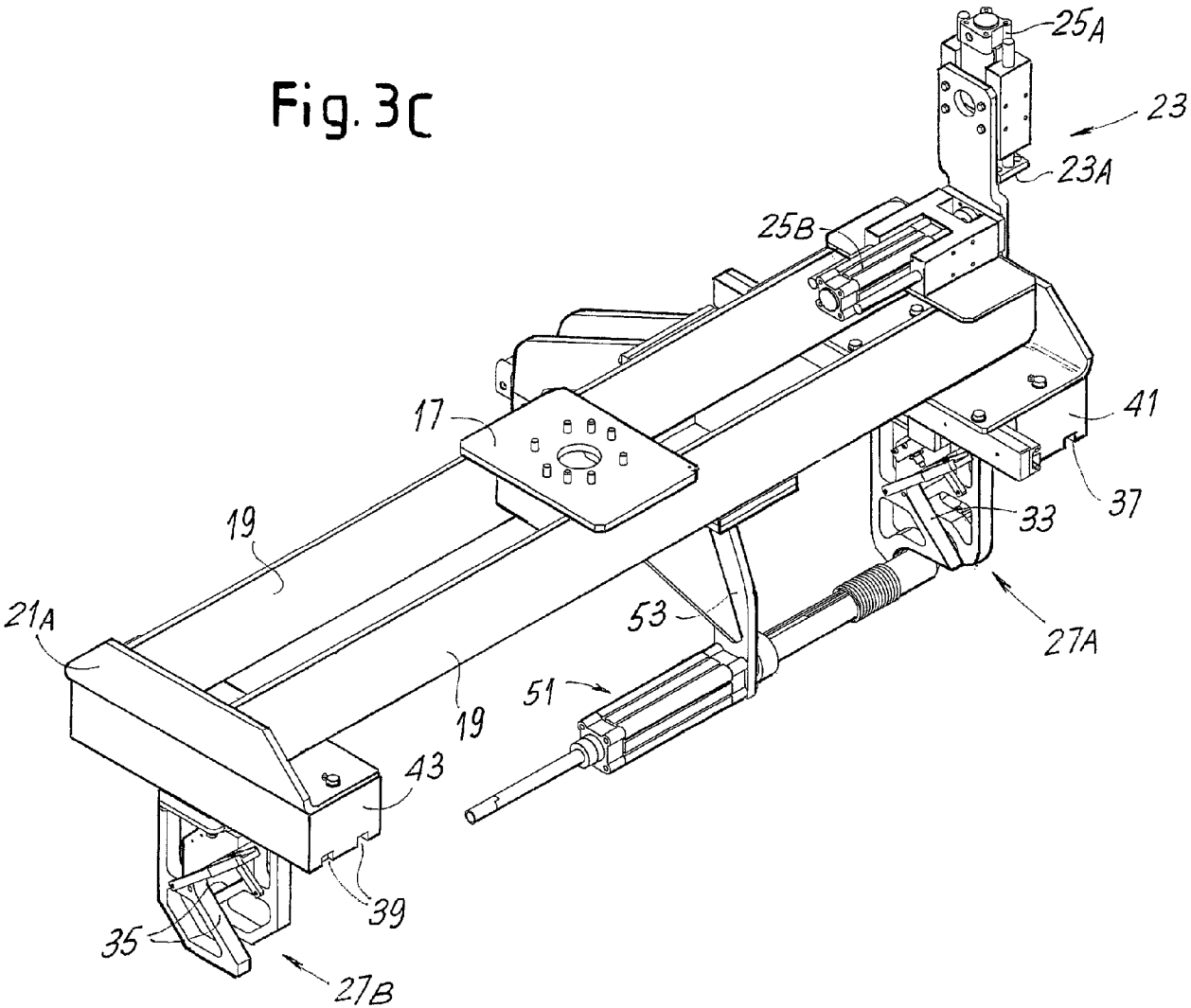
Figure 3D:
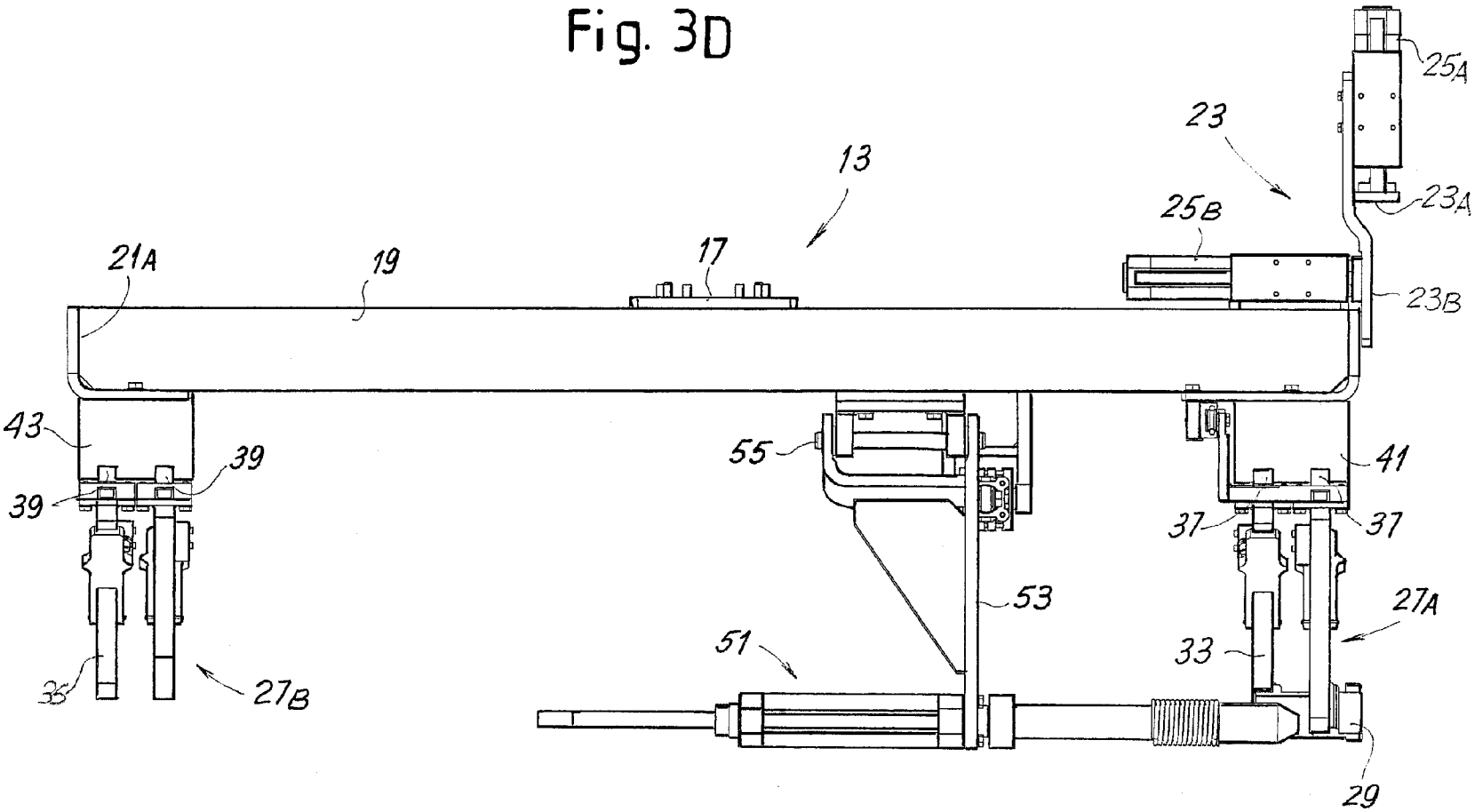
Figure 3E:
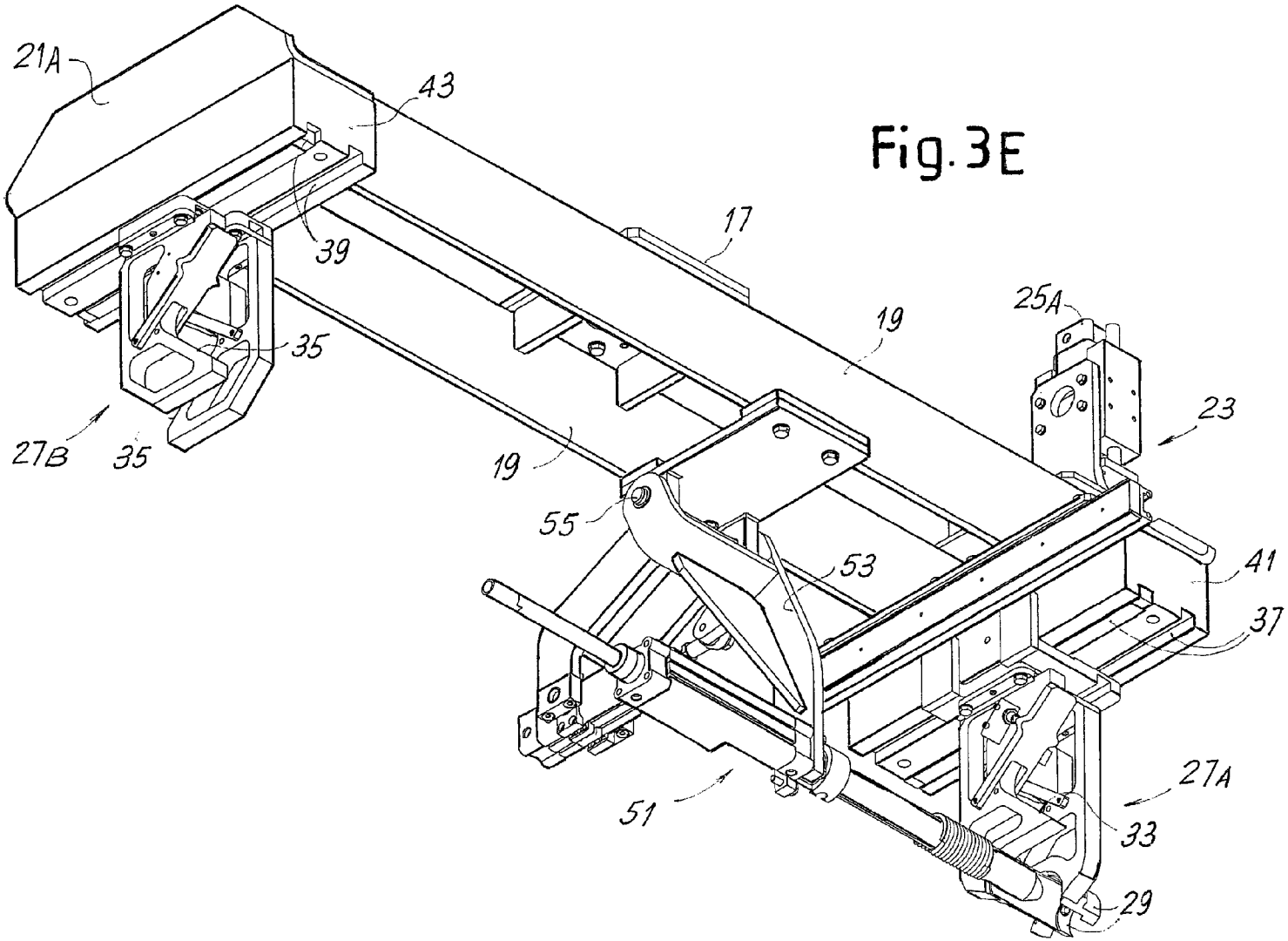

An enlarged plan view of the robot 5 is shown in FIG. 2, and its head, indicated as a whole with 13, is shown in detail in FIGS. 3A and 3E and will be described hereunder. The head 13 is carried by a known arm 15, provided with an adequate number of degrees of freedom.

The head 13 is equipped with a plate 17 for mounting on the arm 15. The plate 17 is integral with two beams 19 joined to one another by means of end plates 21A, 21B. In proximity to the plate 21B a centering device 23 is provided for centering the head with respect to the winding mandrels that have to be extracted from the reels formed in the rewinding machine 1. In an embodiment, the centering device 23 has two abutting surfaces 23A, 23B substantially orthogonal to each other, associated with actuators 25A, 25B. These abutting surfaces 23A, 23B have to come in contact with the end shank of the winding mandrel that has to be extracted from the reels. As the abutting surfaces 23A, 23B are in a given position relative to the head 13, it is possible to know the position of the shank of the mandrel with respect to the head and it is therefore possible to position the head in such a way as to be able to make the mandrel acted upon by the members described below and carried by the head itself, whose function is to carry out the expansion or the contraction of the mandrel and to grip the mandrel to handle it during the various phases of the working cycle, as better described hereunder.

The head is provided with gripping members for gripping the mandrel, in opposite position relative to the plate 17. In an embodiment the gripping members comprise a first pair of jaws 27A and a second pair of jaws 27B. The jaws of the pair 27A are equipped inferiorly with two shaped profiles 29 suitable to engage the shank of the mandrel. In a possible embodiment, the two shaped profiles 29 have approximately semi-cylindrical shape. However, it must be understood that these profiles may have different shapes according to need, e.g. based on the shape of the shank. With one of the profiles 29 a microswitch 31 may be associated, the purpose of which is to verify whether the device correctly gripped the shank of the mandrel.

Above the elements or profiles 29, the pair of jaws 27A presents substantially V-shaped grip surfaces, indicated with 33, to engage the mandrel on the substantially cylindrical lateral surface thereof, possibly with the tubular winding cores inserted thereover.

The pair of jaws 27B is analogous to the pair of jaws 27A but it does not present the elements 29, but instead solely surfaces 35, shaped approximately as a V for gripping and laterally locking the mandrels. The jaws of each pair 27A, 27B slide in specific guides 37, 39 obtained in blocks 41 and 43 carried by the plates 21B and 21A respectively. The opening and closing of the jaws 27A, 27B is commanded by actuators, not shown.

Between the pairs of jaws 27A, 27B an expansion and contraction member is provided, indicated as a whole with 51, for expanding/contracting the winding mandrels. In the illustrated embodiment the expansion and contraction device for expanding/contracting the mandrels is of the pneumatic type. This device is known and used in the traditional systems for expanding and contracting the mandrels. In practice, the device 51 acts on a valve provided on the shank of the mandrels for inflating or deflating the air chambers inside the mandrels, causing their radial expansion or radial contraction to lock or unlock the tubular winding cores relative to the mandrels.

Figures 7, 8:
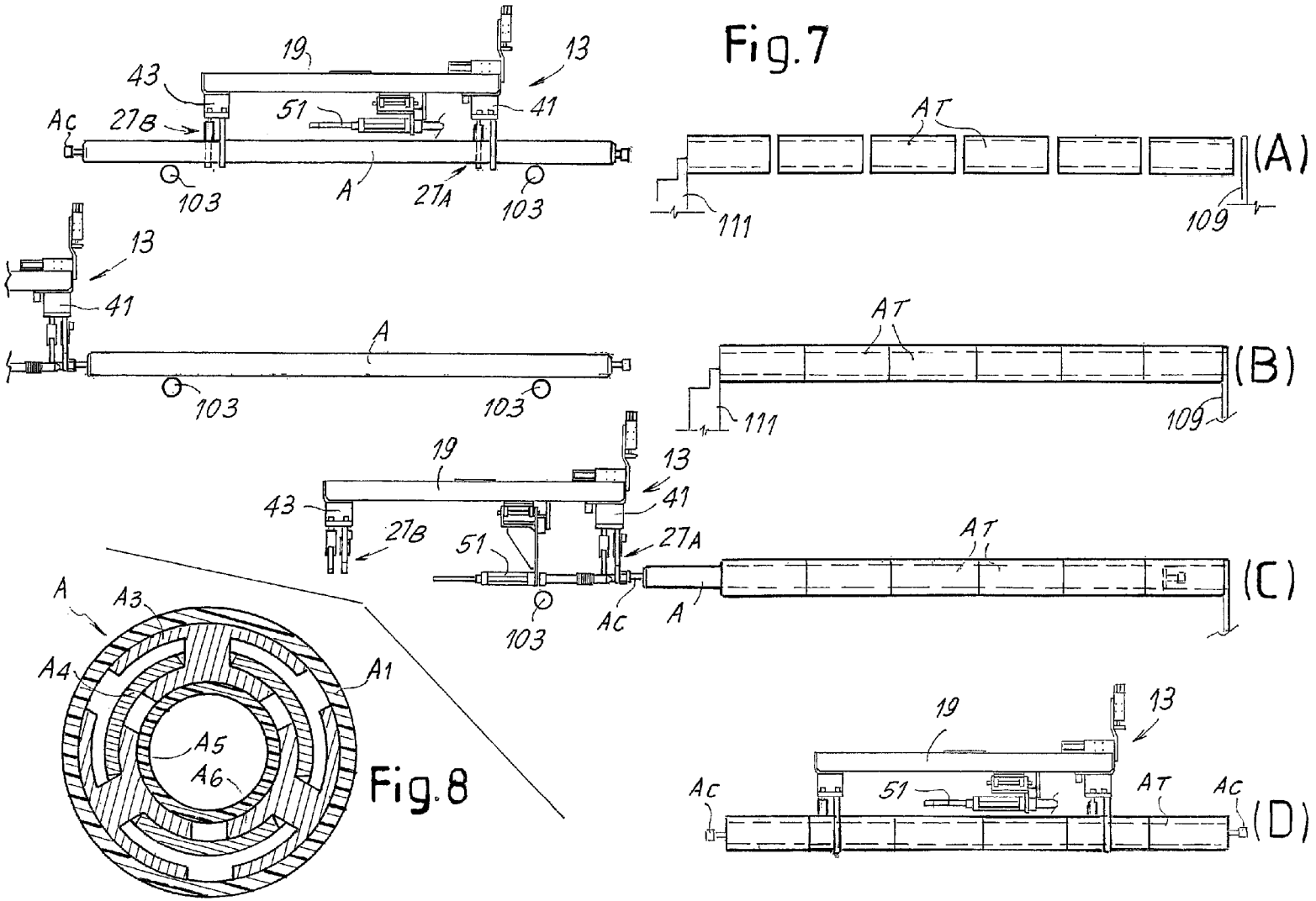
FIG. 8 shows a schematic cross section of a pneumatically expandable winding mandrel.

FIG. 8 shows in cross section an embodiment of a pneumatic expansion mandrel. The mandrel, indicated as a whole with A, comprises a substantially cylindrical outer sleeve A1 of elastomeric material, which defines the approximately cylindrical outer surface of the mandrel. Inside the sleeve A1 three expandable elements A3 are arranged, with a wall having the shape of a portion of a cylindrical surface, radially movable and guided in longitudinal grooves of a tubular element A4. Inside said tubular element A4 an inflatable chamber A5 is arranged, with approximately cylindrical development, which can be inflated or deflated by means of the valve arranged in the shank of the mandrel. The inflatable chamber A5 acts on base elements A6 of the expandable elements, so that the expansion of the inflatable chamber A5 causes the dilation of the elastomeric sleeve A1, whilst when the inflatable chamber deflates the elasticity of the sleeve A1 causes the retraction of the elements A3 and hence the radial contraction of the mandrel.

The expansion and contraction device or member 51 is mounted on a bracket 53 oscillating around a pin 55 integral with the head 13. The oscillating movement is operated by an actuator 57. In the position illustrated in FIGS. 3A and 3E the expansion and contraction member 51 is disposed in its operating position, approximately coaxial to the profiles 29 of the pair of jaws 27A. In this position the expansion and contraction member 51 can act on the end of the shank of the mandrel, which is gripped by means of the profiles 29 of the pair of jaws 27A.

Making the lever or bracket 53 oscillate by about 90° by means of the actuator 57, the expansion and contraction member 51 is brought to an idle position relative to the jaws 27A, 27B. This position is shown in particular in the plan view of FIG. 2, in which the member 51 is at the side of the pair of beams 19 of the head 13. In this position the expansion and contraction member 51 does not interfere in the action of the jaws 27A, 27B which can simultaneously tighten on the cylindrical surface the winding mandrel to actuate it in various positions in the system 3.

By means of the head 13 the robot 5 can perform the operations of deflation or contraction of the mandrel that is located in the group of reels formed by the rewinding machine 1 and gradually extract the mandrel from the reels to bring it, without tubular winding cores, on the insertion station or unit for inserting the mandrel into the series of tubular winding cores provided for the subsequent winding cycle. This operation of extracting the mandrel from the reels that were just formed is carried out as schematically indicated in the sequence of FIGS. 6A-D.

In a first instant the head 13 is approached to the shank AC of the winding mandrel A projecting from the reels BB in the unloading area of the rewinding machine 1 and through the abutting surfaces 23A, 23B the head is brought to a known position relative to the shank AC (FIG. 6A). A subsequent rising of the head by a quantity equal to the distance between the abutment 23A and the axis of the expansion and contraction member 51 brings said member into axial alignment with the mandrel A to be extracted (FIG. 6B). This operation of initial positioning becomes necessary because the position of the axis of the reels BB and hence of the axis of the mandrel to be handled is not known a priori and it is not constant. In fact, it depends upon the diameter of the reels which, in the unloading area of the rewinding machine 1, rest on rollers or other members defining an unloading cradle for the reels.

Once the expansion and contraction member 51 is axially aligned with the mandrel to be extracted, it can act on the mandrel itself causing its deflation, i.e. contraction, acting on the head valve of the mandrel. In the subsequent phase (FIG. 6C) by means of the arm 15 of the robot 5 the head 13 can be extracted by a certain quantity from the group of reels BB. The joining between the head 13 and the mandrel is given in this phase by the elements or profiles 29. When the mandrel is extracted by a sufficient quantity from the reels located in the rewinding machine 1, but is still engaged in the reels BB in such a way as not to fall, and the member 51 having been brought to an idle position relative to the jaws 27A, 27B through the oscillation of the bracket 53, the head 13 can be translated relative to the mandrel thereby gripping the mandrel itself by means of both the pairs of jaws 27A, 27B which grip the mandrel in two axially distanced points. The mandrel thus solidly engaged can be completely extracted from the reels BB and transferred to the unit 9, which will be described hereunder.

Figure 4A:
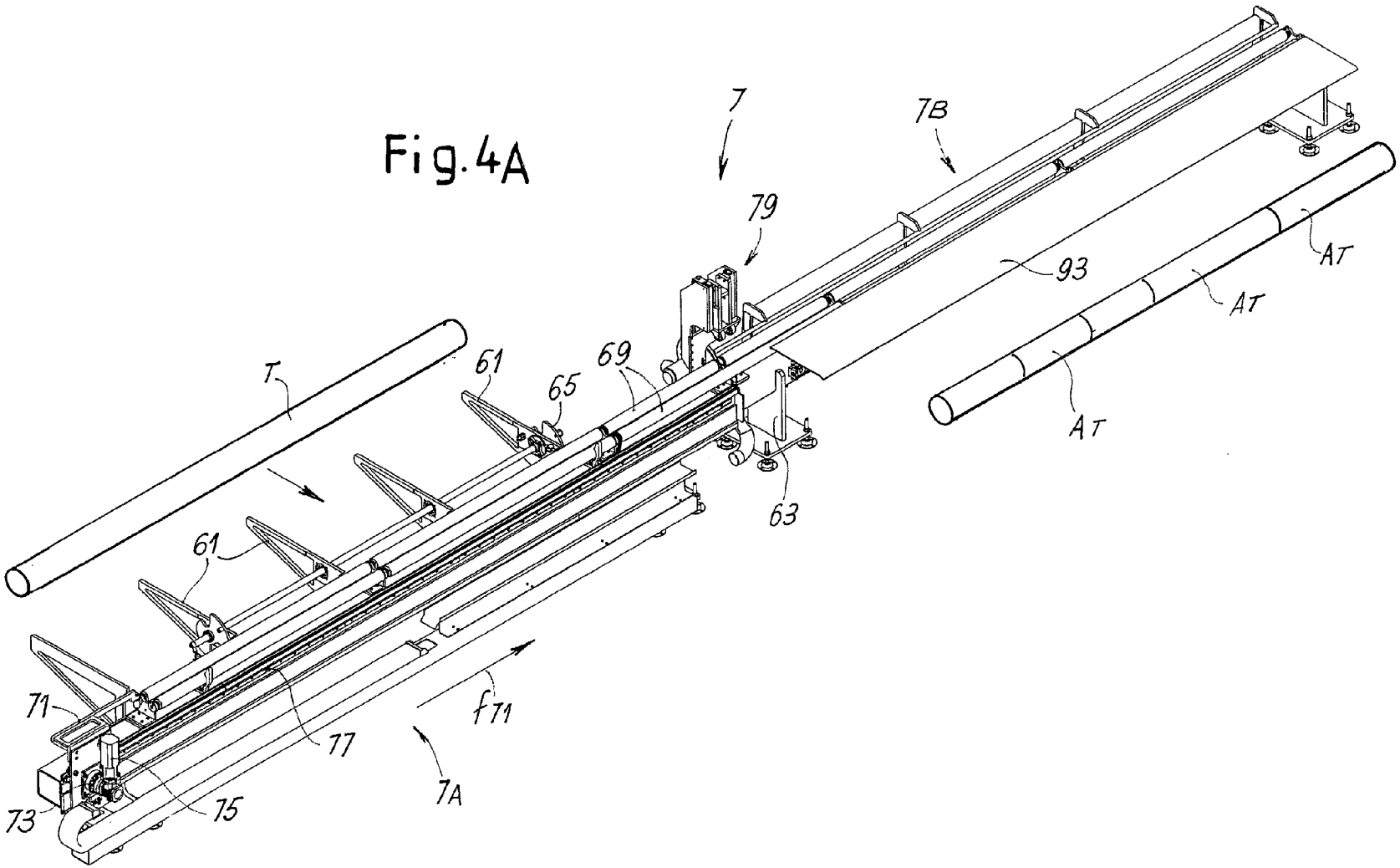
FIGS. 4A, 4B show axonometric views of the cutting unit for cutting the tubes for forming tubular cores, according to two different angles.
Figure 4B:
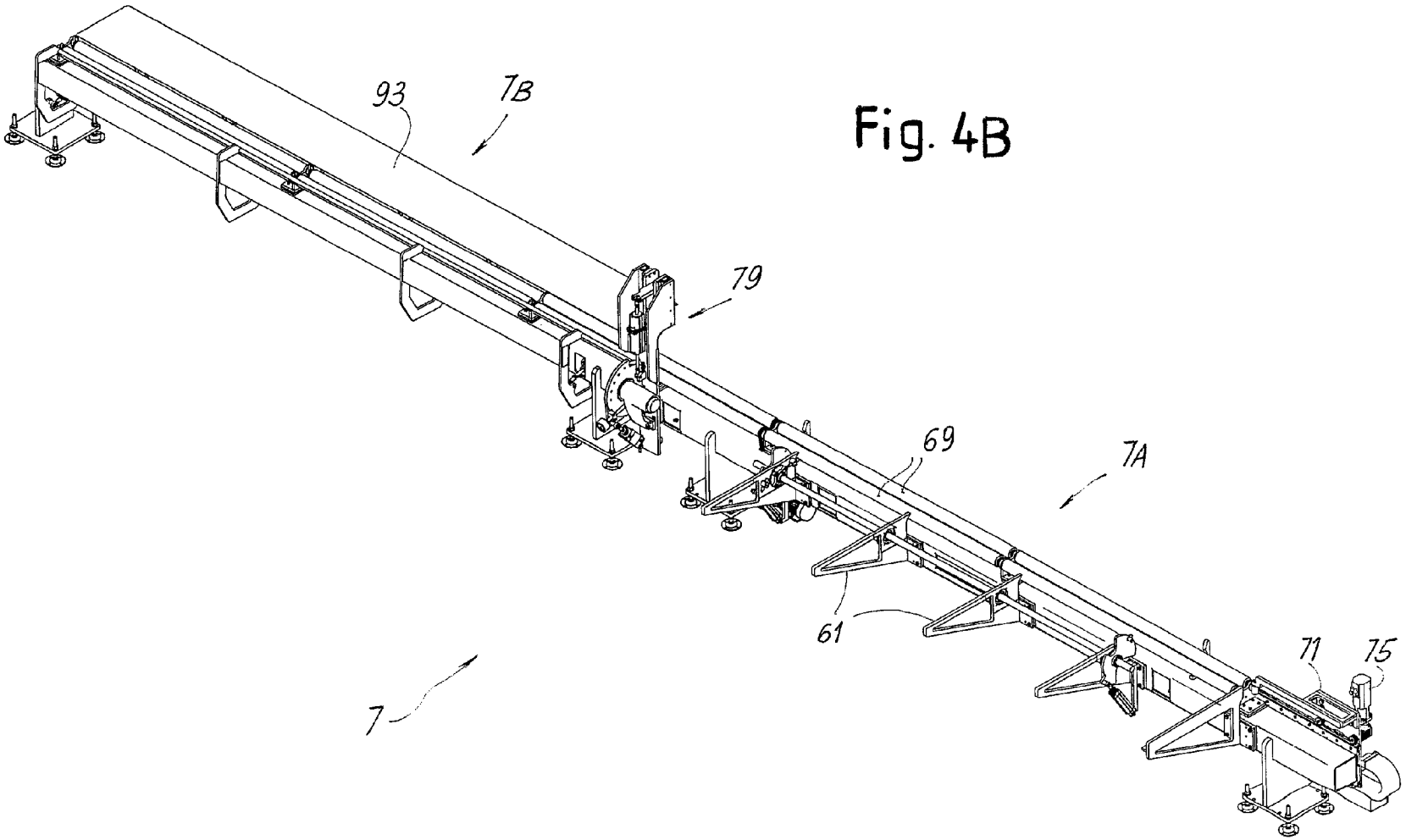
Figure 4C:
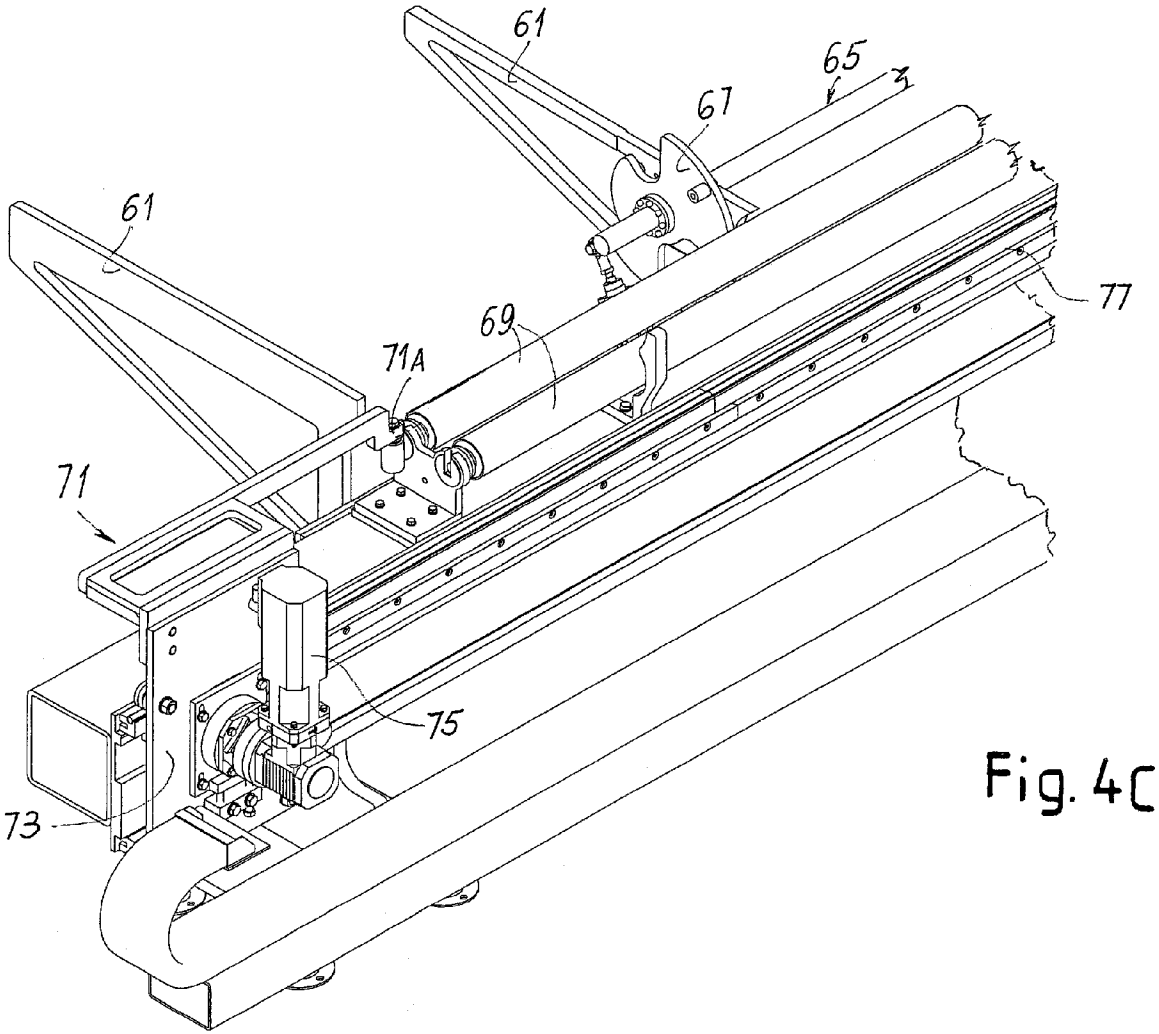
FIG. 4C shows a detail of the pushing system for pushing the tubes towards the cutting group.
Figure 4D:
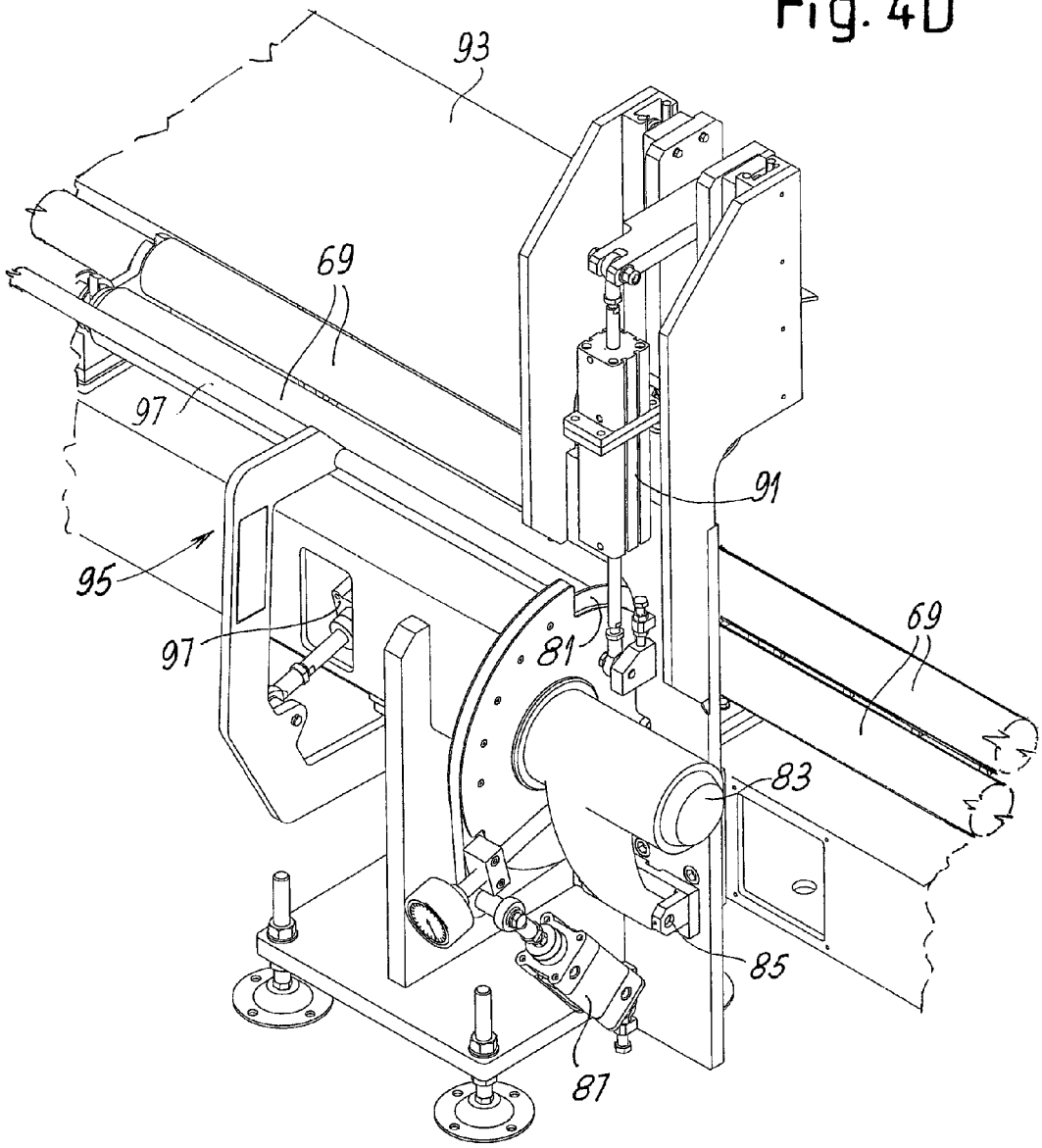
FIGS. 4D and 4E show enlargements in axonometric view of the cutting system according to two different angles.
Figure 4E:
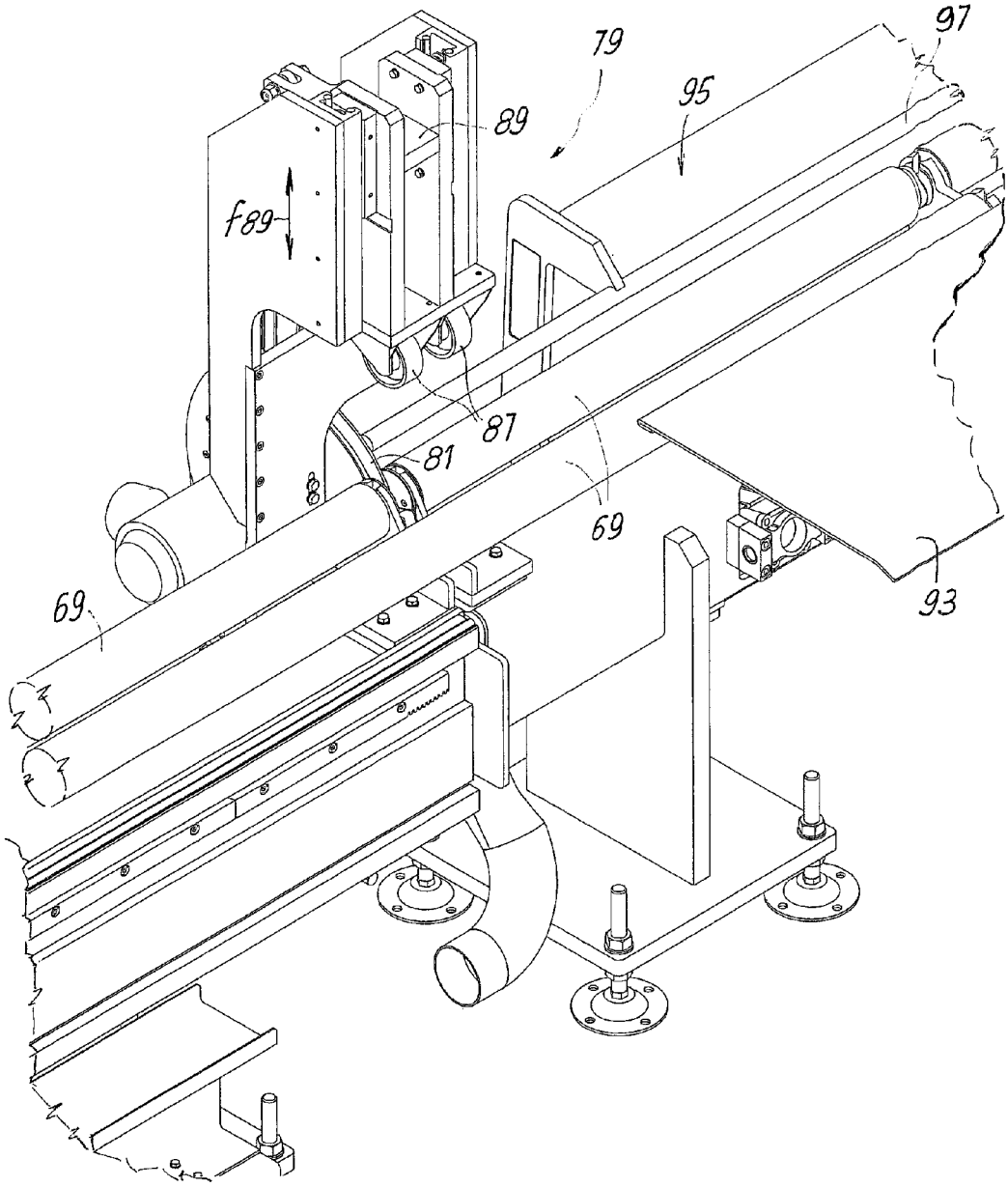

FIGS. 4A and 4E show in detail the structure of the cutting unit 7 for cutting to size the tubular winding cores that must be inserted over the mandrel just extracted from the reels formed in the rewinding machine 1.

The cutting unit or cutting station 7 for cutting tubes to form the tubular winding cores is shown in particular in FIGS. 4A and 4E. This unit is subdivided into a first part 7A and a second part 7B. In the first part tubes T are introduced that are accumulated on supporting surfaces constituted by shelves 61, overhanging relative to a load-bearing structure 63. With the shelves 61, defining an inclined plane on which several tubes T can be accumulated, is associated a rotating or oscillating distributor 65, which presents (FIG. 4C) shaped discs 67 that, through the rotation or the oscillation of the distributor 65, draw individual tubes from the supporting surfaces formed by the shelves 61 and unload them onto a pair of rollers 69 with substantially parallel axes forming a rest cradle. One or both the rollers 69 can be motorized to rotate around their axes, by means of motors not shown. The rollers 69 extend substantially throughout the entire length of the unit 7 and may be subdivided into axially aligned portions, to allow their support.

In the portion 7A of the cutting unit 7 a pusher 71 is provided, carried by a carriage 73 operated by a motor 75 to longitudinally slide in the direction of the arrow f71 (FIGS. 4A and 4C) along a guide 77 substantially parallel to the axial development of rollers 69. The pusher 71 presents an end 71A that acts against a corresponding end of each tube T that must be pushed from the section 7A towards the section 7B of the cutting unit 7 to be subdivided into individual tubular winding cores by means of a cutting member described hereunder.

Between the sections 7A and 7B of the unit 7 a cutting unit 79 is disposed, shown in greater detail in the enlargements of FIGS. 7D and 7E. The cutting unit 79 comprises a disc cutter 81 operated by a motor 83 (FIG. 4D). In an embodiment, the cutter 81 is mounted oscillatingly about a pin 85 substantially parallel to the axis of rollers 69. In an embodiment, a piston—cylinder actuator 87 controls the oscillation of the disc cutter 81 to bring it respectively in cutting position and in an idle position, in which it does not interfere with the tube T. The disc cutter 81 is arranged with its own axis of rotation substantially parallel to the axis of rollers 69 and, therefore, of the tube T that is made to advance stepwise along the longitudinal development of the unit 7.

By oscillating toward the axis of the tube, the cutter 81 can cut the tube T that is held in rotation around its axis by the rollers 69. To withstand the thrust imparted by the disc cutter 81 on the tube during cutting, the cutting unit 79 has two small wheels 87 positioned above the cradle formed by the rollers 69 with axes substantially parallel to the axes of rollers 69. In an embodiment, the wheels 87 can be carried idle on a slide 89, provided with a movement approaching and moving away from the rollers 69, for instance a substantially vertical movement in the direction of the double arrow f89. This movement is controlled by a piston—cylinder actuator 91 (FIG. 4D). The lifting and lowering movement of the wheels 87 brings said wheels respectively in idle position and in support and thrust position on the tube T during cutting to hold said tube inside the cradle formed by the rollers 69.

In the section 7B the cutting unit 7 has a slide 93 on which are made to roll the tubular winding cores AT (FIG. 4A) obtained by cutting each tube T inserted in the cutting unit 7. By controlling the forward movement of the tube T by means of the pusher 71 and the lifting and lowering movement of the contrasting wheels 87, as well as the oscillating movement of the cutter 81, it is possible to subdivide each tube T into the required number of tubular winding cores AT, each of the required length.

For ejecting the tubular winding cores AT produced by means of the members described so far, the cutting unit 7 includes an ejector 95 in the section 7B, which is shown in particular in FIGS. 4D and 4E. The ejector 95 has a bar 97 substantially parallel to the axis of rollers 69, which by means of piston—cylinder actuators housed below the rollers 69 (one of which is indicated with 97 in FIG. 4D) is made to oscillate to push the tubular cores outside the cradle formed by the rollers 69 towards the slide 93.

The slide 93 constitutes the connection (see FIG. 1) between the cutting station or cutting unit 7 and the insertion station or insertion unit 9 for inserting the mandrels A into the tubular winding cores AT cut in the cutting unit 7.

Figure 5A:
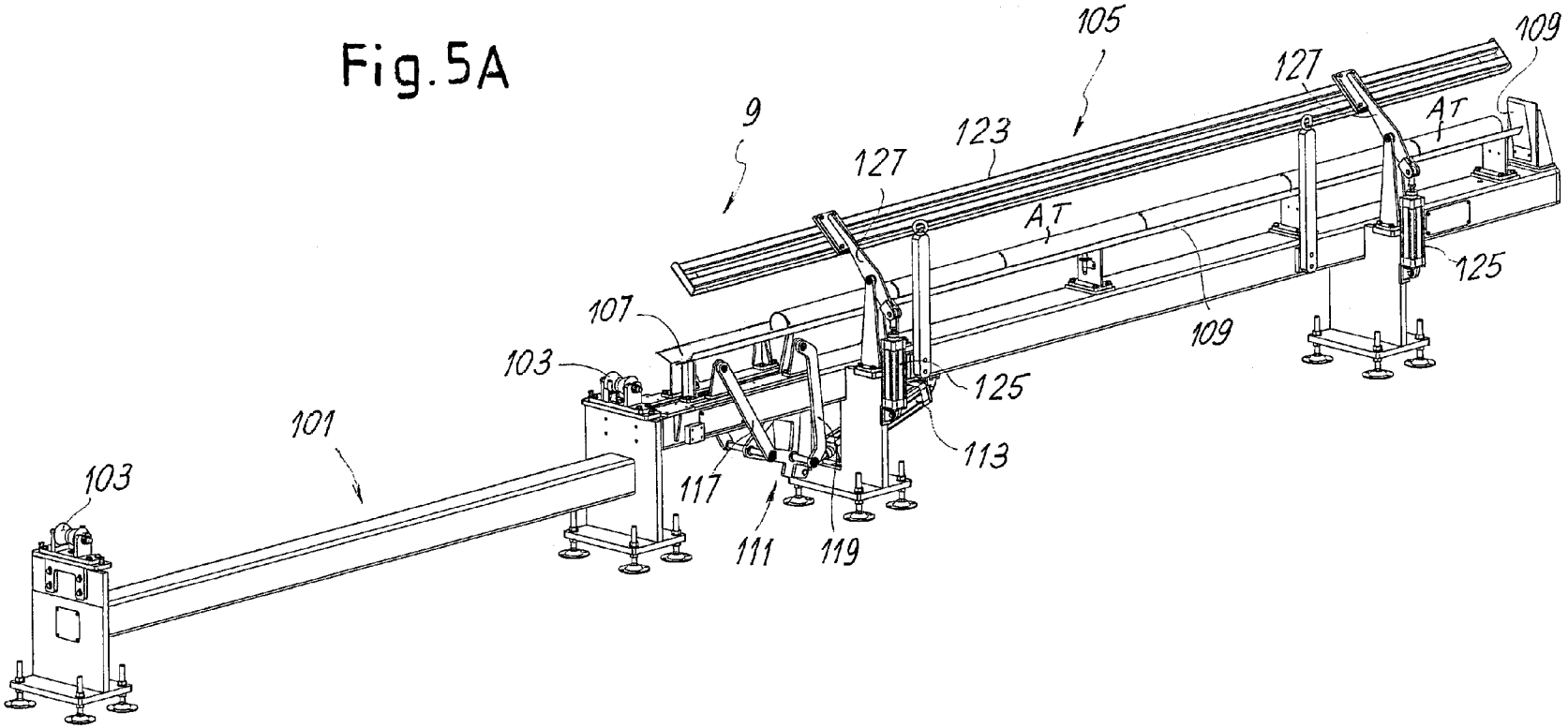
FIG. 5A shows an overall axonometric view of the insertion unit for introducing the winding mandrels into the tubular winding cores.
Figure 5B:
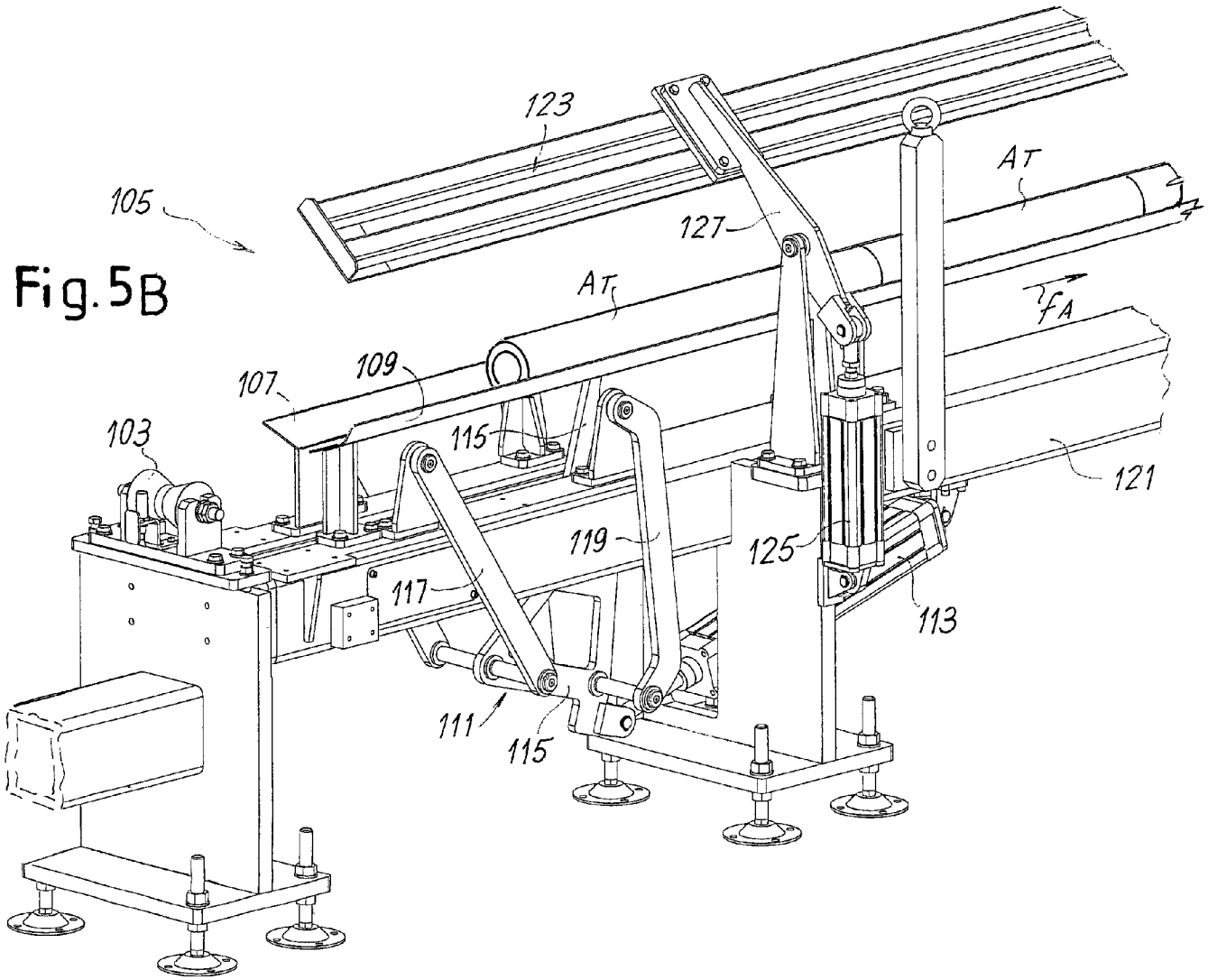
FIG. 5B shows an enlargement of a portion of the unit of FIG. 5A.

The structure of the unit 9 will be now described with particular reference to FIGS. 5A and 5B.

As indicated previously, the unit 9 receives the individual mandrels A removed from the reels wound in the rewinding machine 1 by means of the robot 5 with its head 13, according to the procedure described above (FIGS. 6A-6D). The unit 9 has a rest or support 101 whereon the individual winding mandrels are positioned by the robot 5. The rest or support 101 presents a pair of V-shaped rollers 103 which receive and retain the mandrel that bears on said shaped rollers 103 with its substantially cylindrical surface.

Aligned with the support or rest 101 is a section 105 of the unit 9 where the tubular winding cores AT cut by the unit 7 are received. The section 105 has (see in particular the enlargement of FIG. 5B) a support comprising two plates 107 and 109 which form a sort of cradle for the tubular winding cores AT. The plate 109 is bent in such a way as to form a stop for the cores AT that roll on the slide 93 and from it to the metal plate 107 substantially aligned with the slide 93.

Before introducing the mandrel inside the winding cores AT positioned on the support formed by the plates 107 and 109, said cores must be brought to abut against each other and against an abutting or reference end surface 109. For this purpose, the section 105 includes a compactor device indicated as a whole with 111 (shown in detail in FIG. 5B). The compactor device is operated by a piston—cylinder actuator 113 and includes a movable element 115 connected, by means of rockers 117 and 119, to the load-bearing structure 121 of the section 105 of the unit 9. The articulated quadrilateral system formed by the movable element 115 and by the rockers 117, 119, operated by the piston—cylinder actuator 113, pushes the tubular winding cores AT in the direction of the arrow fA against the abutment 109 and each tubular core abutting the adjacent one.

Above the support formed by the plates 107, 109 in the section 105 of the unit 9 a pusher 123 is provided, which forms a clamping member for clamping the tubular cores. Said clamping member serves to avoid the accidental movement of the tubular winding cores AT during the phase of inserting the winding mandrel into them. The clamping element 123 is operated by piston—cylinder actuators 125 by means of oscillating arms 127.

Insertion of the winding mandrels into the tubular winding cores AT positioned in the unit 9 takes place according to the following sequence, schematically shown in FIGS. 7A-7D. In a first step, the tubular winding cores AT are unloaded on the support 107, 109 and a winding mandrel A is positioned on the pair of shaped rollers 103 (FIG. 7A).

Subsequently, the compactor 111 brings the tubular winding cores AT to abut against each other and against the abutment 109 (FIG. 7B). A microswitch can be associated with said abutment 109, in order to generate a signal indicating that the cores AT are correctly positioned.

At this point, the head 13 of the robot 5 can grip the winding mandrel A (FIG. 7B) and insert it into the tubular cores AT. The insertion may take place by engaging the mandrel with the profiles 29 in correspondence of the shank of the mandrel itself. In this case, the shaped rollers 103 provide for the rest of the mandrel. After insertion, the expansion and contraction member 51 provides to inflate the mandrel thus locking the tubular winding cores AT thereon in the mutual position reached. The head 13 can then translate and position itself so as to engage the mandrel A with the tubular winding cores AT in an intermediate position (FIG. 7D) to transfer it inside the rewinding machine or in the unit 11, in which, after the deflation of the mandrel, the individual tubular cores AT are repositioned at a mutual distance from each other.

During insertion of the winding mandrel A inside the tubular cores AT, the latter are held in position to avoid accidental movements thereof by means of the clamping element 105 as described above.

Clearly, the drawing only shows one embodiment, given simply as a practical example of the invention, which may vary in shapes and arrangement without departing from the context of the present invention. Any reference numerals in the appended claims are provided for the sole purpose of facilitating reading of the claims in the light of the description and the drawing, and do not in any manner limit the scope of protection represented by the claims.

The invention claimed is:

1. A system for preparing winding mandrels with winding cores inserted thereover on which to form reels of web material, the system comprising:

a robot;

a cutting unit for cutting a tube for forming tubular winding cores of settable axial length;

a station for mutually axially distancing the tubular winding cores inserted on a winding mandrel;

an insertion unit for inserting the winding mandrels into a series of previously cut and axially aligned tubular winding cores, wherein said robot is arranged and controlled for:

extracting said mandrel from previously formed reels of web material;

inserting said mandrel in a set of said previously cut and axially aligned tubular winding cores;

transferring said winding mandrel with said previously cut and axially aligned tubular winding core inserted thereover into a rewinding machine to form said reels of web material around said previously cut and axially aligned tubular winding cores.

2. A system as claimed in claim 1, wherein said robot comprises a handling head provided with gripping members for gripping the winding mandrels, and with an expansion and contraction member for expanding/contracting the winding mandrels, to cause the expansion of the mandrels and locking thereon of the tubular winding cores, and the contraction of the mandrels and unlocking of the tubular winding cores from said mandrels, said gripping members comprising two pairs of jaws, aligned for engaging the winding mandrels in two longitudinally distanced points.

3. A system as claimed in claim 2, wherein said expansion and contraction member is a pneumatic member.

4. A system as claimed in claim 2, wherein said expansion and contraction member for expanding/contracting the winding mandrels is adapted to assume an operating position and an idle position with respect to said gripping members.

5. A system as claimed in claim 2, wherein said first pair of jaws is provided with surfaces for engaging an end shank of said winding mandrels.

6. A system as claimed in claim 1, wherein a support for the winding mandrels is associated with said insertion unit, said robot being controlled to transfer the winding mandrels from said support into the tubular cores through an axial movement.

7. A system as claimed in claim 1, wherein said cutting unit and said insertion unit are arranged side by side and connected by a transfer surface of the tubular winding cores.

8. A system as claimed in claim 1, wherein said cutting unit comprises: a cradle for supporting the tubes with a system for rotating the tube to be cut; a cutting member; a feeder to feed the tube to be cut to the cutting member.

9. A system as claimed in claim 8, wherein said supporting cradle comprises a pair of rollers with substantially parallel axes, at least one of said pair of rollers can be motorized to bring said tubes in rotation.

10. A system as claimed in claim 8, wherein said supporting cradle for supporting the tubes extends from opposite sides of the cutting member, on one side being positioned the tubes to be cut and on the other side being collected the tubular winding cores obtained from cutting individual tubes, axially aligned to each other.

11. A system as claimed in claim 8, wherein with said cradle for supporting the tubes there are associated an inlet slide and a distributor that draws individual tubes from said slide and transfers said individual tubes on said cradle.

12. A system as claimed in claim 8, wherein an ejector, which ejects tubular winding cores, axially aligned to each other, towards an introduction unit, is associated with said cradle.

13. A system as claimed in claim 8, wherein said cutting member comprises a disc blade.

14. A system as claimed in claim 8, wherein a pusher is associated with said cutting member, to hold the tube in said cradle against thrust imparted on the tube by the cutting member.

15. A system as claimed in claim 1, wherein an introduction unit comprises a clamping member to hold the tubular winding cores mutually aligned axially during the insertion of the winding mandrel into said tubular winding cores.

16. A system as claimed in claim 1, wherein said insertion unit comprises a compactor to abut axially against each other the tubular winding cores into which has to be inserted a winding mandrel.

17. A system as claimed in claim 1, wherein said robot is designed and controlled to transfer the winding mandrels, with the tubular winding cores inserted thereover, from the insertion unit to a station for mutually axially distancing the tubular winding cores.

18. A method for preparing winding mandrels, whereon are inserted and locked tubular winding cores, the method comprising the steps of:

axially approaching tubular winding cores to each other;

extracting a winding mandrel from previously formed reels of web material;

inserting said mandrel into a set of tubular winding cores previously cut to size and axially aligned;

after inserting said winding mandrel into said tubular winding cores, mutually distancing said winding cores before insertion into a rewinding machine, and transferring said winding mandrel with said tubular winding cores inserted thereof into the rewinding machine to form reels of web material around said tubular winding cores, wherein said winding mandrel is extracted from said previously formed reels of web material and inserted in said tubular winding cores via a handling robot.

19. A method as claimed in claim 18, wherein:

said tubular winding cores are clamped on said mandrel;

the mandrel with the tubular winding cores is transferred from a position of insertion in the tubular winding cores to a position of mutual axial distancing of said tubular winding cores;

the tubular winding cores are unlocked from said mandrel, axially distanced from each other and again locked on the mandrel.

20. A method as claimed in claim 19, wherein said handling robot transfers said winding mandrels from said position of insertion to said position of mutual axial distancing, said mandrel being expanded and contracted to lock and unlock said winding cores on said mandrel via an expansion and contraction member carried by said handling robot.

21. A system, comprising:

a rewinding machine;

a winding mandrel removably connected to one or more previously formed reels of web material;

a robot, said robot removing said wind mandrel from said one or more previously formed reels of web material;

a tube;

a cutting unit, said cutting unit receiving said tube and cutting said tube to form cut tubular winding cores;

an insertion unit, said insertion unit receiving said cut tubular winding cores, wherein said cut tubular winding cores are axially arranged via said insertion unit to form cut and axially arranged tubular winding cores, said robot inserting said winding mandrel in said cut and axially arranged tubular winding cores at said insertion unit;

a station, said station receiving said winding mandrel with said cut and axially arranged tubular winding cores connected to said winding mandrel, wherein one or more of said cut and axially arranged tubular winding cores on said winding mandrel are moved in an axial direction of said winding mandrel via said station to form cut, axially arranged and axially moved tubular cores, said robot transferring said winding mandrel, with said cut, axially arranged and axially moved tubular winding cores connected to said winding mandrel, into said rewinding machine to form new reels of web material about said cut, axially arranged and axially moved tubular winding cores.

22. A system in accordance with claim 21, wherein said cut tubular winding cores are axially arranged via said insertion unit such that each of said cut tubular winding cores is axially aligned with another one of said cut tubular winding cores.

23. A system in accordance with claim 22, wherein said cut and axially arranged tubular winding cores are mutually axially distanced from one another via said station.

24. A system in accordance with claim 21, wherein at least a portion of said insertion unit is arranged adjacent to said cutting device.

25. A system in accordance with claim 24, wherein at least a portion of said station is located between said rewinding machine and said insertion unit.

26. A system as claimed in claim 21, wherein said robot comprises a handling head, said handling head comprising gripping members for gripping said winding mandrel, an expansion and contraction member for expanding and contracting said winding mandrel, to cause expansion of the winding mandrel and locking thereon of said cut, axially arranged and axially moved tubular winding cores, and contraction of the winding mandrel and unlocking of the cut, axially arranged and axially moved tubular winding cores from said winding mandrel, said gripping members comprising two pairs of jaws, aligned for engaging said winding mandrel in two longitudinally distanced points, wherein one pair of said two pairs of jaws is located at a spaced location from another pair of said two pairs of jaws.

* * * * *